United States Patent [19]

Ersoy

[11] 4,278,194

[45] Jul. 14, 1981

[54] MACHINE FOR THE ATTACHMENT OF BUTTONS, RIVETS OR THE LIKE

[75] Inventor: Metin Ersoy, Wuppertal, Fed. Rep. of Germany

[73] Assignee: Schaeffer-Homberg GmbH, Wuppertal, Fed. Rep. of Germany

[21] Appl. No.: 48,420

[22] Filed: Jun. 14, 1979

[30] Foreign Application Priority Data

Jun. 16, 1978 [DE] Fed. Rep. of Germany ..... 2826418

[51] Int. Cl.[3] ..... A41H 37/00

[52] U.S. Cl. ..... 227/18; 227/41; 227/48

[58] Field of Search ..... 227/15, 18, 41, 48, 227/106

[56] References Cited

U.S. PATENT DOCUMENTS

| | | | |
|---|---|---|---|
| 1,388,862 | 8/1921 | Horgan | 227/18 |
| 2,262,150 | 11/1941 | Straw | 227/41 |
| 3,225,993 | 12/1965 | Hall | 227/18 |
| 3,964,661 | 6/1976 | Schmidt et al. | 227/18 |

*Primary Examiner*—John McQuade

*Attorney, Agent, or Firm*—Martin A. Farber

[57] ABSTRACT

A machine for the attachment of buttons, rivets or the like on clothing pieces, the lower parts of which are fed via rails from a magazine laterally oriented up to the vicinity of the attachment position and from there are transferred into the attachment position. The rail which feeds the bottom parts in the edgewise position exits at an angle which is offset by about 90 degrees relative to the attachment position. Between the exit position and the attachment position there extends a circular arc-shaped slide surface starting tangentially from the exit area and running approximately tangentially into the attachment position. A rotatable ring section runs on the slide surface. The ring section, which is equipped on its front end with a reception pocket, transfers respectively one lower part into the attachment position and during its movement its ring-narrow-edge closes the exit of the feed rail.

8 Claims, 10 Drawing Figures

MACHINE FOR THE ATTACHMENT OF BUTTONS, RIVETS OR THE LIKE

Figure 1:
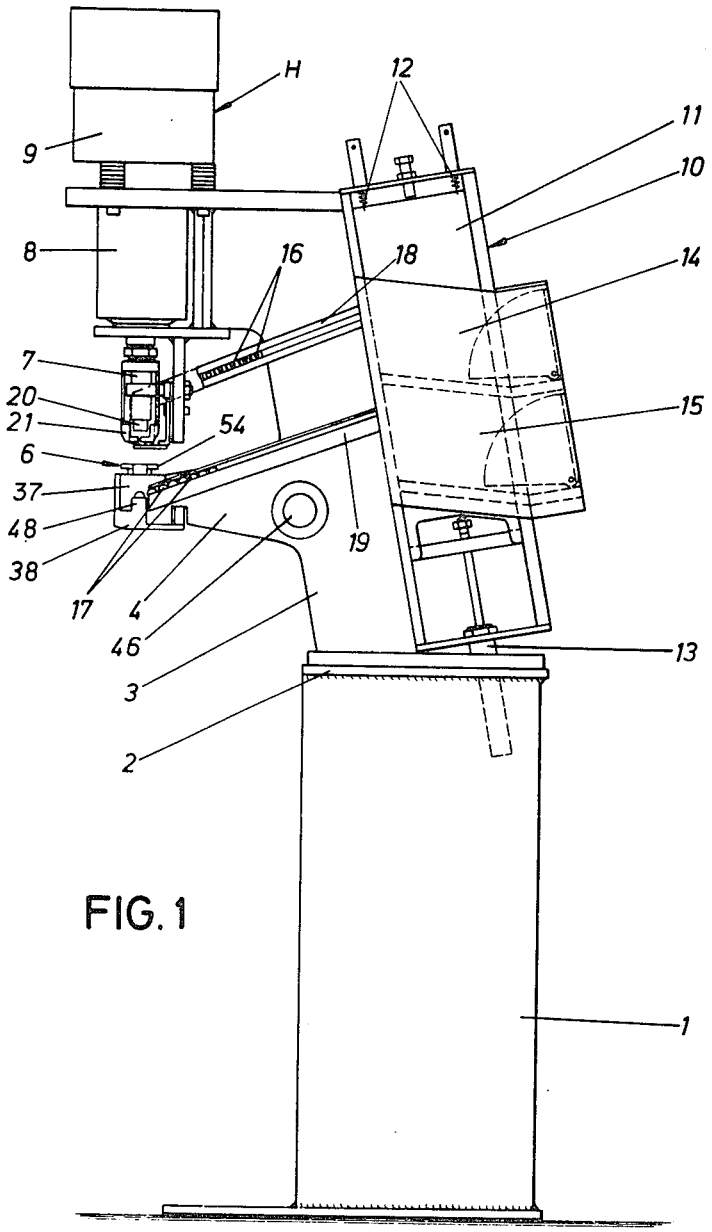

The invention relates to a machine for the attachment of fasteners such as buttons, rivets or the like, comprising upper and lower parts, on clothing pieces, in which the lower parts are fed via rails from a magazine oriented laterally up to the vicinity of the attachment position and from there are transferred into the attachment position.

With the known machines of this type the transfer of the lower parts into the attachment position takes place by means of a linearly moved workpiece insertion slider. Such a workpiece insertion slider is likewise provided for the upper parts. Such type of formation is costly in technical production and frequently leads to operation failures or disturbances.

The object of the invention is based on the task of forming a machine of the previously set-forth type in a simple technical production manner such that the conveyance of the rivet parts, particularly the lower parts, is possible in the attachment position without linearly moved structural parts.

This task is aided in its solution in the manner that the rails which convey the lower parts in the edgewise position mouth (exit) at an angle which is offset by about 90 degrees relative to the attachment position and between the exit or mouth position and the attachment position there extends a circular arc-shaped slide surface starting tangentially from the mouth area and running approximately tangentially into the attachment position, on which slide surface there runs a rotatable ring section, which ring section, equipped on its front end with a reception pocket, transfers respectively one lower part to the attachment position and by its movement its ring-narrow-edge closes the mouth of the conveying rail.

As a result of such formation a machine of the introductory mentioned type is provided in which the means bringing the lower parts to the attachment position are simple in their construction and work without susceptibility to disturbance. Now a linearly moved workpiece insertion slider can be eliminated. The lower parts run over the downwardly inclined conveying rails up to the mouth of the same. From there, respectively one bottom part can roll into the reception pocket of the ring section, in the event the reception pocket is flushly aligned with the mouth. During the operation of the machine, the ring section swings about the axis of the circularly-shaped slide surface, on which slide surface the lower part runs as well. After a displacement path of approximately 90 degrees a transfer of the lower part to the attachment or fastening position occurs. During this swinging, the mouth of the conveying rail is closed by the ring - narrow edge of the ring section. After the transfer the ring section swings back into the loading or receiving position, so that then again a lower part can arrive in the reception pocket of the ring section. In so doing, the back and forth swinging of the ring section takes place synchronously with the stroke of the upper tool, and indeed depending upon the ram movement, for example, by means of a limit switch. Moreover, by means of the rotating component the conveyance path is smaller compared to the known slide construction, which facilitates a quicker disturbance- or trouble-free conveyance or feeding of the lower parts.

The accessibility moreover is made easier and an improved controlled function is provided. Then the corresponding conveying rail is able to run linearly, which likewise contributes to the savings in the production costs.

It proves as advantageous in this regard that the ring section is mounted on both sides of the projecting arm of cylindrical basic shape, the projecting arm forming the circular-arc-shaped slide surface with a partial section of its surface area. In this manner a two-sided-mounting of the ring section exits. The basic form of the ring section thus corresponds approximately to a U, which permits easy insertion and adjustment or alignment of the lower tool stamp.

A drive of simple construction form is therewith achieved by means of a solenoid - toothed-rack control or another appropriate external or separate control of the ring section. For example this can be a pneumatic drive.

In order also to be able to undertake a manual actuation of the rotatable ring section, there is provided capability for operation of the ring section (in the advance or feed direction) free of the drive of the ring section. A manual displacement of the ring section may be performed if, for example, a lower part is missing or a lower part is not correctly attached.

For the easy mounting and dismounting of the lower tool stamp, the outer-sided or external bearing position of the ring section has an opening for accessibility of a holding screw of the lower tool stamp.

Finally it is also of advantage that the face or front end of the ring section moves into a radial opening of a non-rotatable and spring-mounted yieldable or deflectable lower part - reception bushing, the latter surrounding the lower tool stamp. The lower part - reception bushing serves for securing the lower part which has been transferred to the lower tool stamp and as an engagement surface for the clothing piece which is to be provided with the buttons, rivets or the like.

Figure 2:
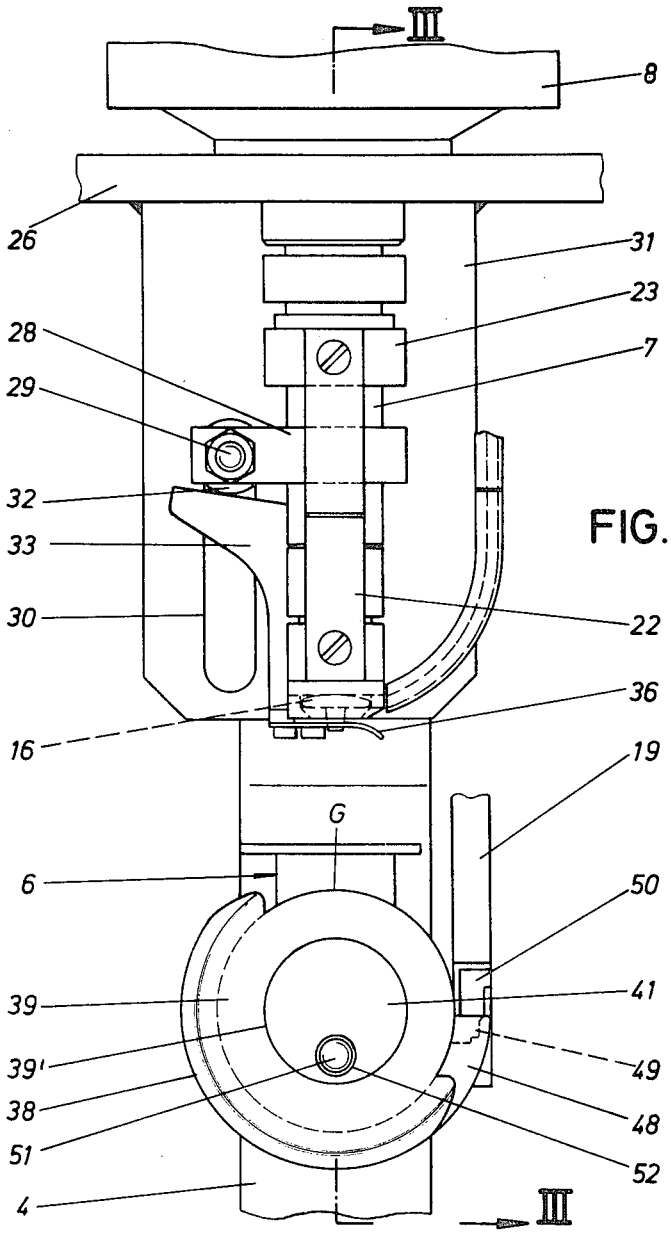
Figure 3:
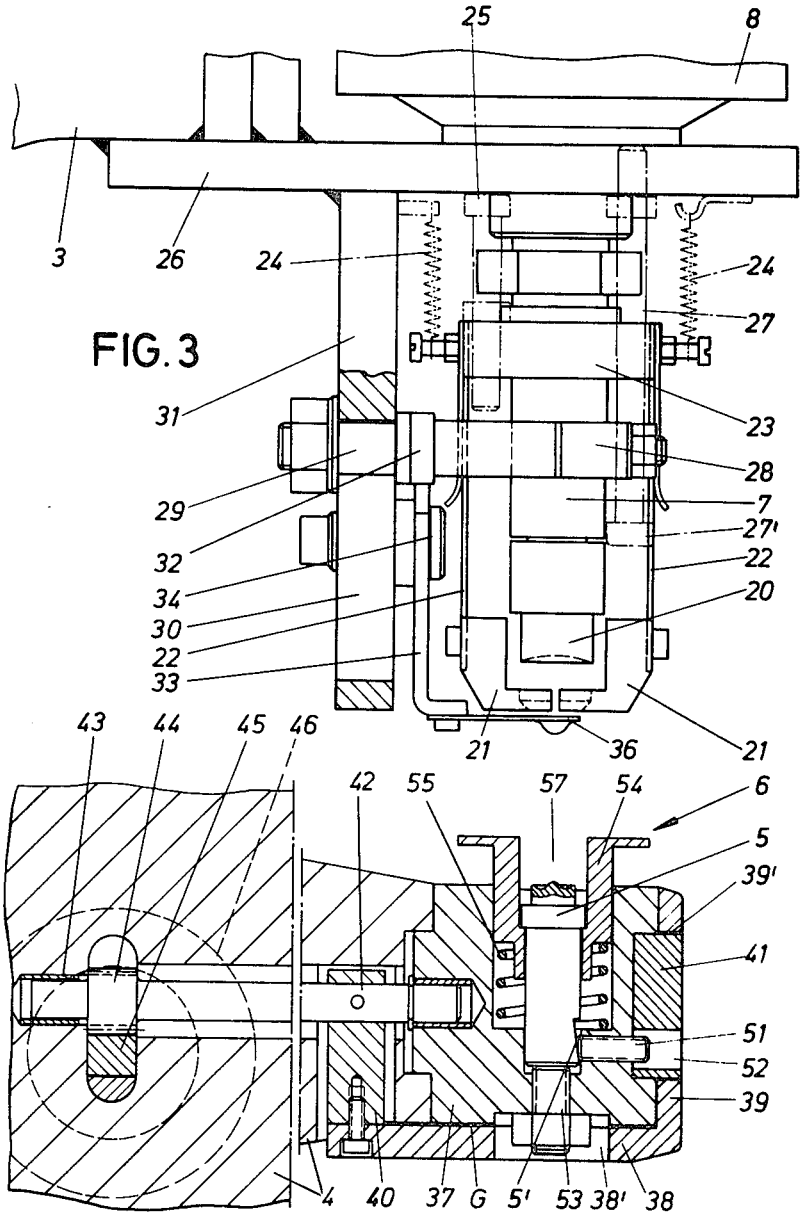
Figure 4:
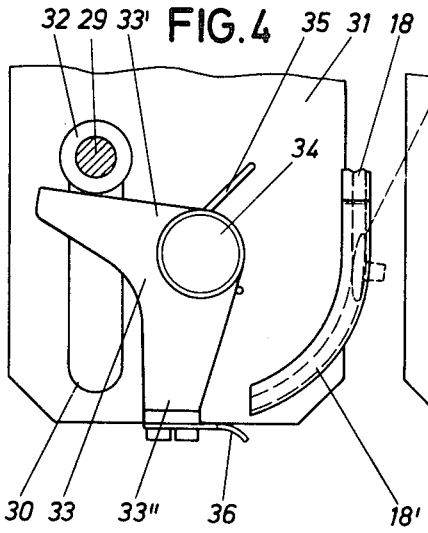
Figure 5:
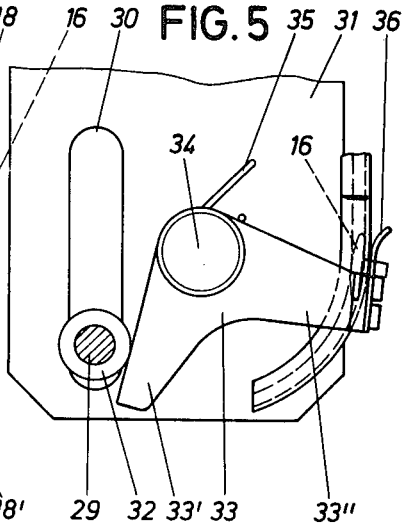
Figure 6:
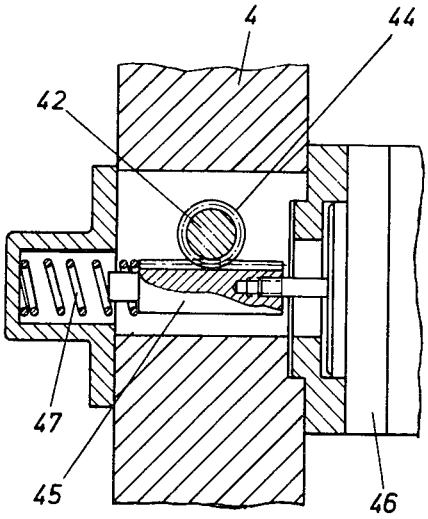
Figure 7:
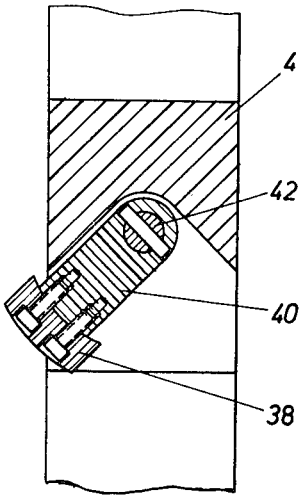
Figure 8:
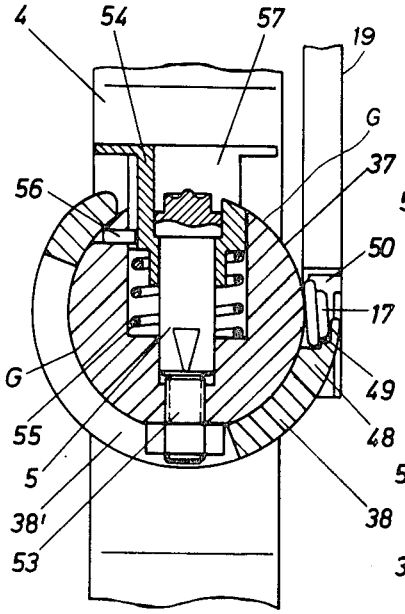
Figure 9:
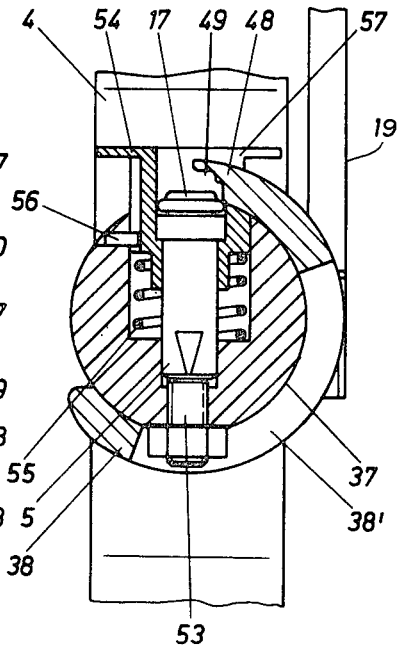
Figure 10:
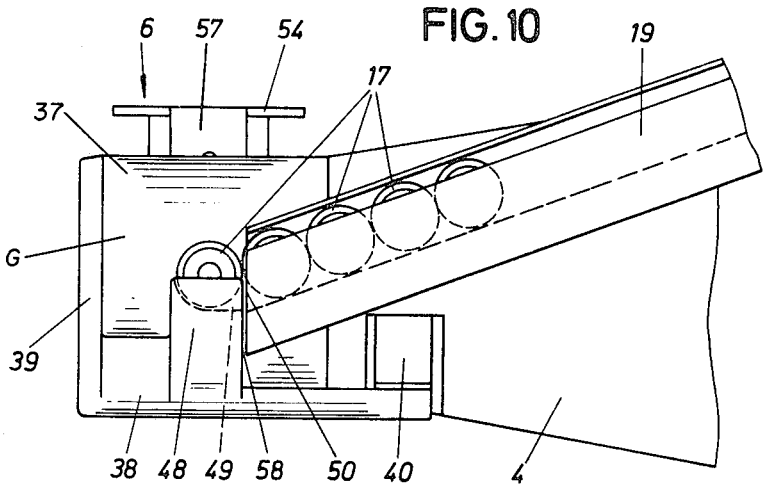

With the above and other objects and advantages in view, the present invention will become more clearly understood in connection with the detailed description of a preferred embodiment, when considered with the accompanying drawings, of which:

FIG. 1 shows a side view of the machine,

FIG. 2 in an approximately actual scale shows a front elevational view towards the upper and lower tool, FIG. 3 shows a longitudinal section according to the lines III—III in FIG. 2, FIG. 4 is an elevational view towards the transfer lever of the upper tool in the base or normal position, and FIG. 5 shows an illustration corresponding to FIG. 4, whereby the transfer lever is displaced by the downwardly moved ram by means of the pressure roller, FIG. 6 shows a cross section through the projecting arm in the range of the solenoid, the latter driving the ring section, FIG. 7 shows a cross section through the projecting arm through the range of one bearing stay of the ring section, FIG. 8 shows a cross section through the lower tool in the range of the lower tool stamp in the starting position, FIG. 9 is an illustration corresponding to FIG. 8, however, with the ring section pivoted by about 90 degrees and, FIG. 10 shows a side view elevational view towards the projecting arm, and indeed seen in the direction of the conveying rail.

The machine for the attachment of button, rivets, or the like on clothing pieces has a machine stand or pedestal 1. The table top 2 of the latter carries the machine housing 3, from which machine housing the projecting arm 4 extends, directed forwardly. The projecting arm is equipped with the lower tool 6. The ram 7 extends flushly aligned above the lower tool 6, the ram 7 obtaining its stroke by the electromagnets 8 and 9 which are accommodated in a common housing H, connected in series or one behind the other. The electromagnet 8 is the weaker magnet. The weaker electromagnet 8 effects the idling or no load stroke, while the stronger electromagnet 9 effects the operating stroke.

The magazine 10 extends in back of the machine housing 3. The magazine 10 contains a slider 11 which is movable back and forth. The upward movement is caused by means of the tension springs 12 and the downward movement by means of the lifting cylinder 13. The magazine 10 is equipped with magazine chambers 14 and 15 which are arranged on both sides of the slider, from which chambers the upper parts 16, and respectively, the lower parts 17 are conducted via conveying guide rails 18 and 19, respectively, to the upper tool stamp 20 and the lower stamp 5, respectively.

The upper tool stamp 20 is inserted in the free end of the ram 7. The clamping jaws 21 extend on both sides of the upper tool stamp 20, the clamping jaws being carried by resilient tongues or tabs 22. The resilient tongues 22 extend from the carriage 23 which is guided movably on the ram 7. Tension springs 24 act on the carriage 23, which tension springs displace the carriage and consequently, via the resilient tongues 22, the clamping jaws 21 in the upward direction. The upward movement is limited by the abutment or stop screw 25, which screw is rigidly connected with the carriage 23 and steps with its screw head against a plate 26 of the machine housing 3. Furthermore, a guide pin 27 is provided which is formed as a screw, which guide pin extends through the carriage 23 and which with the screw head 27′ limits the downward movement of the carriage.

Moreover the ram 7 carries the clamped-on driver 28, on which driver a guide bolt 29 is applied. The guide bolt 29 passes through a longitudinal slot 30 of the guide plate 31 of the machine housing 3. The guide bolt 29 supports the pressure roller 32, which pressure roller acts on or engages one angle leg 33′ of the angle-shaped transfer lever 33. The latter is mounted about the pin 34 of the guide plate 31 and is acted upon by the rotary or torsion spring 35, which spring 35 biases the transfer lever 33 in the clockwise direction. The other angle leg 33″ is equipped with a leaf spring 36 which serves for the purpose of conveying upper parts 16 to the clamping jaws 21, and namely from the bent section 18′ of the upper guide rail 18.

The projecting arm 4 with a front part section 37 of its surface area forms the circular-arc-shaped slide surface G for the ring section 38, which ring section runs on the slide surface G. Stays 39 and 40 originate on both sides of the ring section 38. The front stay 39 contains a bearing opening 39′ which is penetrated by a front sided annular collar 41 of the projecting arm 4. The shaft 42 serves for mounting the stay 40. The shaft 42 on one side is mounted in the front section of the projecting arm and on the other side in a bushing or sleeve 43 of the projecting arm 4. Near the bushing 43 the shaft 42 carries the pinion 44, which pinion intermeshes with the toothed rack 45 of the solenoid 46 constituting a drive for the ring section. The free end of the toothed rack 45 is biased by a compression spring 47, which results in a free operation in the advance or feed direction, i.e. without operation or operative connection of the drive of the ring section 38.

The annular section 38 is provided with a projecting finger 48, which finger is equipped on its face or front end with a reception pocket 49 for the lower parts 17. The reception pocket 49 in the starting or normal position of the ring section 38 is aligned flush with the mouth 50 of the lower conveying or feed rail 19. The mouth 50 is aligned such that it is tangential to the slide surface G of the partial section 37. The attachment or fastening position extends tangentially to the slide surface G, also angularly off-set, the attachment position being located at the upper end of the lower tool stamp 5. The lower tool stamp 5 is anchored or secured by means of the fixing screw 51, which screw passes through an opening 52 of the outer-sided or external bearing 41 and presses against a wedge surface 5′ of the lower tool stamp 5. A displacement in height of the lower tool stamp 5 can be made by means of the set screw 53, for which purpose the ring section 38 forms the recess 38′.

The lower tool stamp 5 is surrounded or encompassed by a lower part - reception sleeve 54. A compression spring 55 biases the reception bushing 54 in the upward direction and a radial pin 56 limits the upper movement of the lower part - reception bushing 54. The latter forms a radial opening 57 which is adjusted to the finger 48.

The following manner of operation takes place:

By actuation of a non-illustrated foot switch the electromagnets 8, 9 receive their pulses, to step into operation. In so doing the upper tool ram 7 moves downwardly. Already during the previous stroke the corresponding rivet parts have been coordinated to the upper tool stamp 20 and the lower tool stamp 5. During the downward travel of the upper tool ram, the upper tool stamp 20 engages the clamping jaws 21 and carries these in the downward direction against their spring biasing. Simultaneously the clamped-on driver 28 moves in the downward direction, and in so doing its pressure roller 32 pivots the transfer lever 33 and brings the transfer lever into the position according to FIG. 5, in which position its leaf spring positions itself behind an upper part 16. During the stroke of the upper tool ram 7 the carriage 23 also was moved against the head 27′ of the screw 27, which limits the movement of the carriage. A further moving down of the upper tool stamp 20 then leads to a spreading apart of the clamping jaws 21. Then the connection of the rivet parts 16 and 17 takes place by means of the stamps 5 and 20.

Simultaneously with the upward movement of the upper tool ram, the solenoid 46 receives a pulse by means of a not-illustrated limit switch, whereby the toothed rack 45 of the solenoid is displaced. By means of the drive pinion 44 the toothed rack drives the ring section 38, which ring section brings a lower part 17, which has been conveyed in an edgewise upright position (FIG. 8), from the position according to FIG. 8 into the horizontal position according to FIG. 9, thus the ring section travels a swinging path of approximately 90 degrees and transfers the lower part to the lower tool stamp 5. Subsequently the finger 48 moves back into the starting position according to FIG. 8.

After the completed upward movement the transfer lever 33 has also returned into its starting position according to FIG. 2 and 4, and in so doing has transferred an upper part 16 to the clamping jaws 21. A free run of the transfer lever 33 as well as of the ring section 38 is available such that a manual actuation is provided in case an upper or lower part, respectively, was not inserted or a part was not attached, respectively.

In the pivoted position of the ring section 38, the mouth 50 of the conveying rail 19 is closed by the narrow edge 58 of the ring.

Before the downward movement of the upper tool ram 7, it is also possible for the ring section 38 to assume the position according to FIG. 9. With the downward movement of the ram 7, then the solenoid 46 receives its pulse for the pivoting of the ring section 38 into the position according to FIG. 8. After the connection of the rivet parts has been made the compression spring 47 brings the ring section 38 including a new lower rivet part 17 into the position according to FIG. 9. In this case the transfer lever 33 and the ring section 38 pivot synchronously.

I claim:

1. In a machine for the attachment of fasteners on clothing pieces, the fasteners comprising upper parts and lower parts adapted to be attached together by upper and lower tool stamps on the clothing pieces at an attachment position, with a magazine adapted to store the parts of the fasteners and being oriented laterally relative to the attachment position, a feed rail extending from the magazine up to a vicinity of the attachment position feeds the lower parts to this vicinity, and swingable means for transferring the lower parts from this vicinity into the attachment position, the improvement wherein said feed rail has an exit mouth at said vicinity and constitutes means for feeding the lower parts to said exit mouth in a substantially edgewise-upright position, said exit mouth is located at an angle offset by about 90 degrees relative to the attachment position, a slide surface extends from said exit mouth up to the attachment position, said slide surface is circularly arc-shaped, beginning tangentially from said exit mouth and running substantially tangentially into the attachment position, a rotatable ring section having a bearing surface rotatably running on said slide surface, said ring section on a front end thereof forms a reception pocket constituting means for receiving one of said lower parts, respectively, at said exit mouth with said one lower part substantially oriented in the edgewise-upright position and positioned against said slide surface and running against said slide surface in said reception pocket during rotation of said ring section on said slide surface, directly delivering and transferring said one lower part into the attachment position and simultaneously turning said one lower part via said slide surface from said edgewise-upright position substantially into a horizontal position at the attachment position, and said ring section on said said front end has a narrow edge, the latter during the rotatable running of said ring section on said slide surface being positioned closingly against the exit mouth of the feed rail.

2. The machine according to claim 1, further comprising a machine housing, a projecting arm having a basic cylindrical form extends from said machine housing, said projecting arm has a partial section of its surface area forming said arc-shaped slide surface, said ring section is substantially of U-shape and is rotatably mounted about opposite sides of said partial section corresponding to opposite legs of the U-shape.

3. The machine according to claim 2, wherein said circularly arc-shaped slide surface has a substantially horizontal axis, said ring section has an annular arc section engaging around said slide surface, said ring section is horizontally rotatably mounted on said slide surface, said annular arc section forms said bearing surface of said ring section and is circularly arc-shaped complementary to said circularly arc shaped slide surface of said partial section of said projecting arm, said annular arc section is substantially of U-shape being open defining ends spaced apart from one another adapted for easy mounting on said circularly arc-shaped slide surface, one of said ends constituting said front end, said annular arc section is formed with an arcuate recess, said partial section of said projecting arm is formed with a partial section recess in which the lower tool stamp is disposed, said partial section recess extends completely through said partial section from a top portion to a bottom portion thereof, a set screw is disposed in said bottom portion of the partial section recess and adjustably engages said lower tool stamp and projects into said arcuate recess of said annular arc section, said partial section has a substantially circular front face formed with a side opening, said ring section has a front stay adjacent to said front face of said partial section, said front stay is formed with a front stay opening aligned with said side opening of said partial section, a bearing complementarily disposed in said side opening and said stay opening, said projecting arm has an intermediate portion forming a V-shaped recess, drive means for rotating said ring section comprising, said ring section is formed with an inner stay projecting radially in said V-shaped recess in said intermediate portion of said projecting arm, a shaft extends through said intermediate portion of said projecting arm and is aligned axially with respect to said horizontal axis of said arc-shaped slide surface, said shaft is connected to said inner stay for joint rotatable movement, means for rotating said shaft, spring means for return biasing rotation movement of said shaft, said shaft and said ring section jointly being manually movable against said spring means.

4. The machine according to claim 1, further comprising driving means for the external rotatable driving control of said ring section.

5. The machine as set forth in claim 4, wherein said ring section is moveable free of the drive of the ring section in a delivery direction.

6. The machine according to claim 1, further comprising a solenoid toothed-rack means for rotatably drivingly controlling said ring section.

7. In a machine for the attachment of fasteners on clothing pieces, the fasteners comprising upper parts and lower parts adapted to be attached together by upper and lower tool stamps on the clothing pieces at an attachment position, with a magazine adapted to store the parts of the fasteners and being oriented laterally relative to the attachment position, a feed rail extending from the magazine up to a vicinity of the attachment position for feeding the lower parts to this vicinity, and swingable means for transferring the lower parts from said vicinity into the attachment position, the improvement wherein said feed rail has an exit mouth at said vicinity and constitutes means for feeding the lower parts to said exit mouth in a substantially edgewise-upright position, said exit mouth is located at an angle offset by about 90 degrees relative to the attachment position, a slide surface extends from said exit mouth up to the attachment position, said slide surface is circularly arc-shaped, beginning tangentially from said exit mouth and running substantially tangentially into the attachment position, a rotatable ring section runs on said slide surface, said ring section on a front end thereof forms a reception pocket adapted to receive a lower part, transfer respectively said lower part into the attachment position and has a narrow edge, the latter during movement of said ring section being positioned closing the mouth of the feed rail, an external bearing means for mounting said ring section, said external bearing means is formed with an opening, a holding screw means for holding the lower tool stamp, said screw means extends through said opening.

8. The machine according to claim 7, further comprising a reception bushing is non-rotatably spring-mounted adjacent said slide surface, said reception bushing forms a radial opening adapted to receive a lower part through said radial opening from said ring section, said reception bushing surrounds the lower tool stamp, the front end of said ring section constitutes a finger, said finger is moveable into said radial opening during rotation of said ring section.

* * * * *